US010109407B2

(12) United States Patent
Pourrahimi

(10) Patent No.: US 10,109,407 B2
(45) Date of Patent: Oct. 23, 2018

(54) STRUCTURAL SUPPORT FOR CONDUCTION-COOLED SUPERCONDUCTING MAGNETS

(71) Applicant: Nadder Pourrahimi, Waltham, MA (US)

(72) Inventor: Nadder Pourrahimi, Waltham, MA (US)

( * ) Notice: Subject to any disclaimer, the term of this patent is extended or adjusted under 35 U.S.C. 154(b) by 721 days.

(21) Appl. No.: 14/164,066

(22) Filed: Jan. 24, 2014

(65) Prior Publication Data

US 2016/0163439 A1 Jun. 9, 2016

(51) Int. Cl.

| | |
|---|---|
| ***F17C 3/00*** | (2006.01) |
| ***F17C 3/08*** | (2006.01) |
| ***H01F 6/04*** | (2006.01) |
| ***H01F 27/10*** | (2006.01) |

(52) U.S. Cl.

CPC ..... *H01F 6/04* (2013.01)

(58) Field of Classification Search

CPC ..... F17C 2203/0308; F17C 2203/0312; F17C 2203/0316; F17C 2203/014; F17C 2203/015; F17C 2203/016; F17C 2203/017; F17C 2203/018; F17C 2203/0621; F17C 2203/0631; F17C 2203/0641; F17C 3/08; F17C 3/085; F17C 13/001; F17C 13/006; F17C 13/007; F17C 2221/017; F17C 2209/221; F17C 2209/232; F17C 2209/234; F17C 2203/0375; F17C 2203/0379; F17C 2203/0383; F17C 2203/0387; F17C 2203/0391; F17C 2203/0612;

(Continued)

(56) References Cited

U.S. PATENT DOCUMENTS 3,192,733 A * 7/1965 Goetz ..... F17C 3/085 62/45.1
3,430,450 A * 3/1969 Bogner ..... F17C 6/00 62/49.2

(Continued)

FOREIGN PATENT DOCUMENTS

JP 60217673 A * 10/1985 ..... F17C 3/085
JP 06094862 A * 4/1994

*Primary Examiner* — Frantz Jules
*Assistant Examiner* — Erik Mendoza-Wilkenfe
(74) *Attorney, Agent, or Firm* — Arjomand Law Group, PLLC

(57) ABSTRACT

A method, a system, and an article of manufacture are disclosed for a structure to support and thermally insulate superconducting magnets, which need to be cooled and kept cool at very low temperatures while also allowing rotational and translational movement of the magnet and/or magnet system without bending or otherwise deforming the support structure. In various embodiments, the support structure is placed within a vacuum vessel to substantially reduce or eliminate convection heat transfer. The support structure is further coupled with the superconducting magnet via enclosing structural components having sufficient second moment of inertia to resist bending forces, at least some of the enclosing structural components being made of low-heat conducting material, while at least some of the other enclosing structural components having reflective surfaces to reduce or eliminate radiation heat loss.

19 Claims, 3 Drawing Sheets

(58) Field of Classification Search
CPC .. F17C 2203/0624; H01F 27/10; H01F 27/18; H01F 27/22; H01F 6/04; F25D 19/006
See application file for complete search history.

(56) References Cited

U.S. PATENT DOCUMENTS

| | | | | | |
|---|---|---|---|---|---|
| 3,894,403 | A * | 7/1975 | Longsworth | F25D 19/006 | 505/892 |
| 4,502,296 | A * | 3/1985 | Ogata | F17C 3/085 | 174/15.4 |
| 4,878,351 | A * | 11/1989 | Weber | F17C 3/085 | 62/297 |
| 5,144,810 | A * | 9/1992 | Nagao | F04B 37/08 | 165/4 |
| 5,530,413 | A * | 6/1996 | Minas | H01F 6/00 | 324/318 |
| 9,213,073 | B2 * | 12/2015 | Aley | G01R 33/387 | |
| 2005/0202976 | A1 * | 9/2005 | Killoran | G01R 33/3815 | 505/200 |
| 2007/0096740 | A1 * | 5/2007 | Fukuda | G01R 33/30 | 324/321 |
| 2007/0204630 | A1 * | 9/2007 | Tsuda | G01R 33/3815 | 62/47.1 |
| 2009/0049863 | A1 * | 2/2009 | Wang | F25D 19/00 | 62/608 |
| 2010/0050661 | A1 | 3/2010 | Snow | | |
| 2011/0039707 | A1 * | 2/2011 | Burgess | G01R 33/3815 | 505/163 |
| 2012/0180899 | A1 * | 7/2012 | Dickerson | F17C 3/08 | 141/1 |

* cited by examiner

STRUCTURAL SUPPORT FOR CONDUCTION-COOLED SUPERCONDUCTING MAGNETS

CROSS-REFERENCE(S) TO RELATED APPLICATION(S)

This application claims the benefit of the filing date of the U.S. Provisional Patent Application 61/756,083, entitled "Structural Support of a Superconducting Magnet Cooled by Conduction" filed on 24 Jan. 2013, under 35 U.S.C. § 119(e).

TECHNICAL FIELD

This application relates generally to superconducting magnets. More specifically, this application relates to a method and apparatus for structurally supporting a superconducting magnet primarily cooled by conduction.

BRIEF DESCRIPTION OF THE DRAWINGS

The drawings, when considered in connection with the following description, are presented for the purpose of facilitating an understanding of the subject matter sought to be protected.

DETAILED DESCRIPTION

Figure 1:
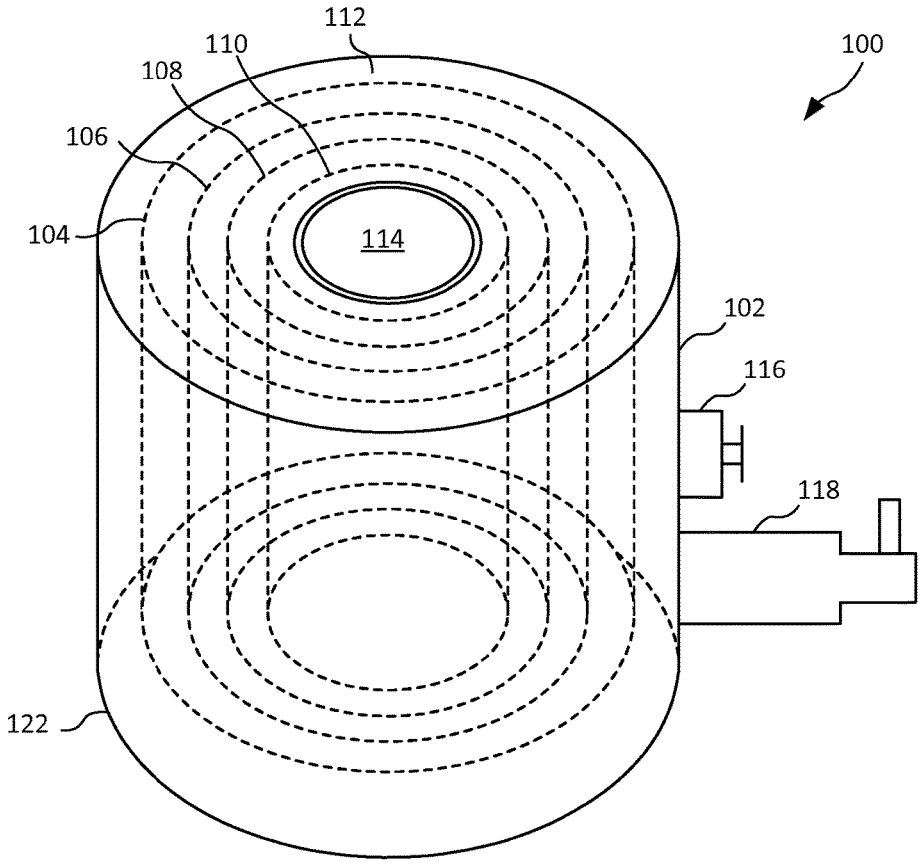
FIG. 1 shows an example vacuum chamber containing structural support for a superconducting magnet thermally insulated from its external environment.

While the present disclosure is described with reference to several illustrative embodiments described herein, it should be clear that the present disclosure should not be limited to such embodiments. Therefore, the description of the embodiments provided herein is illustrative of the present disclosure and should not limit the scope of the disclosure as claimed. In addition, while the following description references application of superconducting magnets in MRI (Magnetic Resonance Imaging) scanners, it will be appreciated that the disclosure may apply to other superconducting magnet applications and other structural support applications in which thermal insulation may be needed, such as magnetic levitation, plasma physics systems, superconducting magnetic energy storage systems, and the like.

Briefly described, a method, a system, and an article of manufacture are disclosed for a structure to support and thermally insulate superconducting magnets, which need to be cooled and kept cool at very low temperatures while also allowing rotational and translational movement of the magnet and/or magnet system without losing the mechanical and operational integrity and without bending or otherwise deforming the support structure. In various embodiments, the support structure, along with other parts of the superconducting magnet, are placed within a vacuum vessel to substantially reduce or eliminate convection heat transfer to the superconducting coils or other cold mass. The support structure is further coupled with the superconducting coils of the magnet system via enclosing structural components having sufficient second (or area) moment of inertia to resist bending forces, at least some of the enclosing structural components being made of non-conducting or low-heat conducting material, while at least some of the other enclosing structural components having reflective surfaces to reduce or eliminate radiation heat loss.

Some applications need powerful magnets generating uniform, constant, and stable magnetic fields of one or more Tesla (T). Permanent or natural magnets typically generate a magnetic field of less than one T, and so superconducting magnets are often needed for generating more powerful magnetic fields. However, superconducting materials, including electromagnets made from superconducting material often require very low temperatures, on the order of a few degrees Kelvin (K), which is near absolute zero.

Superconducting magnets that use low-temperature superconductors, for example, Nb—Ti and $Nb_3Sn$, operate at very low temperatures of 3-15 K. One method of cooling down such a superconducting magnet to these very low temperatures is by using a two stage cryocooler (also known as a cryo-refrigerator) that makes physical contact with designated parts of the magnet system thereby extracting heat by way of conduction through the connected parts. This method of cooling is commonly referred to as being cryogen free, or conduction cooling.

The amount of cooling (removal of heat) that is provided by a two stage cryocooler can be a few tens of watts for the first stage achieving, for example, a temperature of 30-60 K, and a few watts for the second stage achieving 3-10 K. Therefore, the amount of heat transferred (also known as heat leak) to the superconducting magnet from the environment should be reduced to or be lower than the cooling capacity of the cryocooler, if the desired temperature is to be maintained.

Typically, a superconducting magnet includes several parts including a cryostat (often in the form of a vacuum vessel), radiation shield, mechanical support structure, electrical connection, various sensors, valves, and coils made from superconducting wires. For the superconducting magnet to operate properly and produce the required magnetic field, the coils made from superconducting wires (superconducting coils) and the structure and connections that keep the coils together, and in place within the overall magnet need to be kept at below the critical temperature of the superconducting coils. Hereafter the superconducting coils and the structure and connections that keep the coils together may be referred to as cold-mass.

Figure 2:
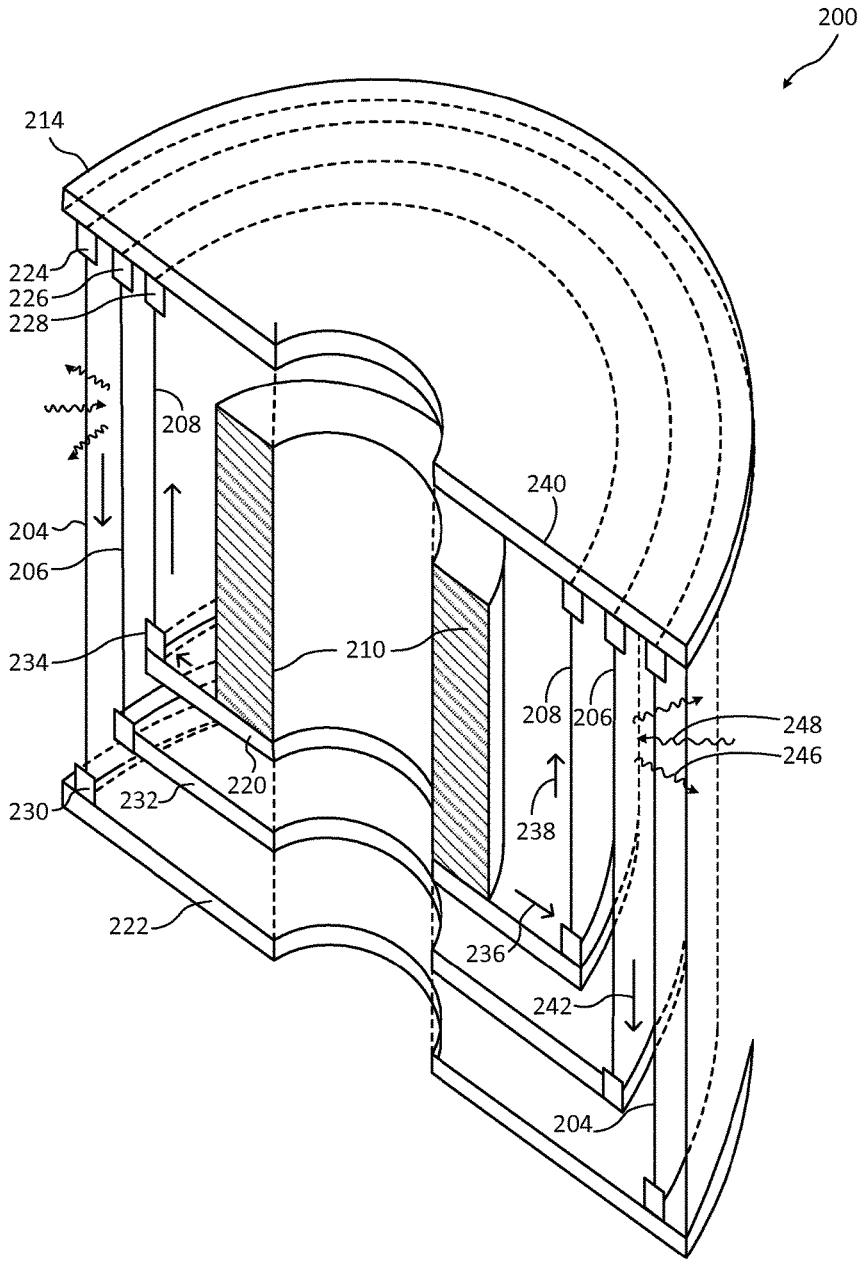
FIG. 2 shows an example interior cross section of the example vacuum chamber of FIG. 1, revealing concentric or nested structural chambers used to support the superconducting magnet.
Figure 3:
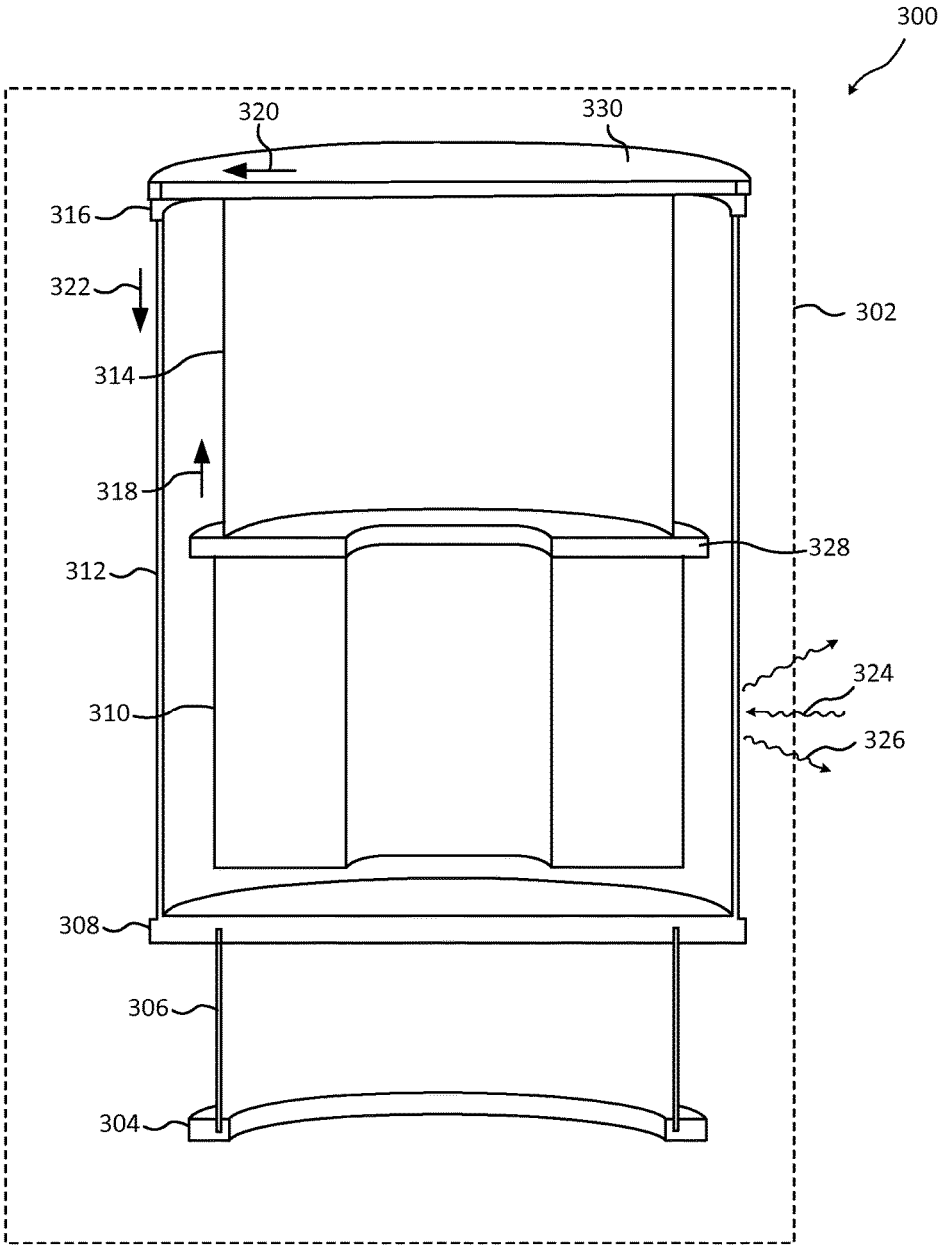
FIG. 3 shows an alternative example cross section of another example embodiment vacuum chamber containing structural support for a superconducting magnet thermally insulated from its external environment.

Heat transfer to or from a body, or a cold-mass, is by way of convection using a working fluid, radiation (no physical contact or material needed), and conduction via physical contact. Convection heat transfer is reduced by removing the working fluid, such as air, surrounding the magnet. Air may be removed by housing the superconducting magnet or cold-mass inside a vacuum chamber. Radiation heat transfer is reduced by housing the cold-mass inside a radiation shield, which in turn is housed within the vacuum chamber. This radiation shield is cooled by the first stage of the cryocooler to a temperature of 30-60K, and is generally covered on the side facing the vacuum chamber with several layers of reflective insulation, often referred to as superinsulation, as shown in FIGS. 2 and 3 and discussed later.

One main path of conduction heat leak to the radiation shield and the cold-mass is through the structural components that support the weight of the radiation shield and cold-mass. The amount of conduction heat leak is reduced by minimizing cross sectional area of structural components, increasing the conduction path through these components, and choosing materials with low heat conductivity for these components.

Various embodiments discussed herein allow the supporting of the weight of a radiation shield and cold-mass while keeping the heat leak to the two stages of the cryocooler to well within the cooling capacity of the cryocooler.

FIG. 1 shows an example vacuum chamber containing structural support for a superconducting magnet thermally insulated from its external environment. It is an outline of a cryogen-free (CF) class superconducting magnet In various embodiments, as an example, a superconducting magnet system may be included in an Extremities MRI (EMRI) system for medical diagnostics usable with head and limbs for some patients. Typically, an EMRI diagnostic scanner includes a superconducting magnet having a scanning bore 114 to accommodate an extremity, such as an arm or a leg of a patient. The CF superconducting magnet may include an outer vacuum chamber 102 enclosing a cold-mass 110, and thermal insulation structural components 104, 106, and 108 (similar thermal insulation structural components may also be deployed in the space between components 110 and 114). The vacuum chamber 102 may further include a top plate 112 and a bottom plate 122. The thermal insulation structural components may support the cold-mass 110 via an internal base plate 120 that couples cold-mass 110 to the thermal insulation layer 108, and yet a separate internal base plate may support and couple thermal insulation layers 104 and 106. The CF superconducting magnet may typically include a cryocooler 118 and a vacuum valve 116.

In various embodiments, the support structure for the cold-mass and the radiation shield perform a number of functions including structural support of the weight of the cold-mass and other components within the vacuum vessel, high resistance to bending during movement and positioning of the superconducting magnet or other system containing the cold-mass, cooling of the cold-mass, substantial reduction or elimination of convective heat transfer, substantial reduction or elimination of radiation heat transfer, and substantial reduction or elimination of conductive heat transfer, as further described below.

In various embodiments, the vacuum chamber is equipped with valve 116 to be used to evacuate air from within the vacuum vessel using a pump, or by other means and mechanisms. In various embodiments, the vacuum pressure needs to be low enough to substantially eliminate air, and thus, convective heat transfer from within the vacuum vessel and around the superconducting magnet to be kept at cryogenic temperatures. To withstand the external pressure created by such near complete internal vacuum, the vacuum chamber needs to be structurally sufficiently strong and well-sealed to guard against air leakage back into the chamber. In various embodiments, the valve 116 may be located on different sides of the vacuum chamber than shown in FIG. 1. For example, the valve 116 may be coupled with the vacuum chamber 102 via the top plate 112 or bottom plate 122.

In various embodiments, the thermal insulation structural components 104-108 are configured to provide a sufficient second moment of inertia at least along the scanning bore 114 so that if the scanning bore is being moved or positioned differently, the weight of the magnet, system, or other force does not cause unallowable bending, torsion, or other structural or mechanical deformation of the structural support and/or any of its structural components. In some embodiments, concentric or nested cylinders or cubes may be used to implement the thermal insulation structural components. In other embodiments the weight may be only supported in one intended direction, and moving or positioning in other directions may not be required and in those other directions the thermal structural layers may be thinner and offer less structural support.

In various embodiments, the thermal insulation structural components include two types of components: conduction insulation structural components and radiation insulation structural components or radiation shields. The conduction insulation structural components may be used to directly or indirectly support the weight of the magnet by suspension or other coupling. The conduction insulation components may be made of low heat conducting materials and further isolate the magnet by being coupled with the magnet via insulating and/or sealing coupling members deployed between these components and the plates 112, 120, and 122. In various embodiments, the conduction path from the cold mass, the target of cooling like superconducting coils, may only be conductively connected to the surrounding external environment via a long and low-conductivity path created by the conduction insulation structural components. This path may be generally substantially longer than the direct distance from the cold mass to the surrounding environment. In some embodiments, this actual conduction path may be several times longer than the direct distance.

In various embodiments, the radiation shields enclose the cold-mass and/or all or some of the conduction insulation structural components to limit radiative heat from outside of the cold-mass to the cold-mass being kept cool at cryogenic temperatures. Reflective layers or coating may be applied to the radiation shields to substantially reflect radiative heat from parts outside of the radiation shield away from the parts inside the radiation shield.

In various embodiments, a two stage cryocooler 118 may be used to cool down the interior of the magnet system. A first stage may cool down the radiation shield and a second stage may cool down the cold-mass, the target of the cooling system. For example, the cold-mass of a superconducting magnet system, which is to be held at about 5 degrees K, may be cooled by the second stage. In various embodiments, the cryocooler 118 may be located on different sides of the vacuum chamber than shown in FIG. 1. For example, the cryocooler 118 may be coupled with the vacuum chamber 102 via the top plate 112 or bottom plate 122.

FIG. 2 shows an example interior cross section of the example vacuum chamber of FIG. 1, revealing concentric or nested structural chambers used to support the superconducting magnet. In various embodiments, magnet system 200 includes a vacuum vessel forming a part of the magnet system, which further includes superconducting magnet 210 enclosed in concentric or nested cylindrical insulation structural components similar to barrels. These concentric or nested components include radiation shield 206 coupled with radiation shield plate 232, reflecting incident radiation rays 248 as reflective rays 246, conduction insulation structural components 204 and 208 creating a long conductive path as signified and identified by the straight arrows in order 236 via magnet support plate 220, arrow 238 via conduction insulation component 208, arrow 240 via coupling plate 214, and arrow 242 via conduction insulation component 204 to bottom plate 222. Those skilled in the art will appreciate that bottom plate 222 may be any type of structural member, plate or otherwise, where some or all of the support/insulating structure is anchored, which in various embodiments is a part of the vacuum vessel. Structural member or bottom plate 222 may have various shapes including a plate as shown in FIG. 2 or be otherwise. Various insulation components 204-208 may be coupled to various plates 214, 220, and 222 via coupling members 224, 226, 228, 230, and 234.

In various embodiments, when the cold mass of a CF or conduction-cooled superconducting magnet is housed inside a vacuum chamber, the supporting structural components of the cold-mass enumerated above may be anchored to the vacuum vessel body. This physical contact between the support components and the housing may potentially be a major source of heat leak to the magnet from outside. The embodiments discussed herein reduce or minimize this heat leak at least in two ways. First, by limiting the heat conduction path to structural components physically connecting the magnet to the housing by the use of polymers, fiber reinforced polymers, or other low heat conductivity materials as structural components to reduce thermal conduction. And second, by arranging the structural components in multiple sequential segments extending from bottom plate 222 to coupling plate 214, and from coupling plate 214 to magnet support plate 220. These structural components and plates may be cooled by the cryocooler as further described below.

With continued reference to FIG. 2, in various embodiments, a cylindrical tube of fiber glass epoxy composite such as Garolite may be used as the thermal conduction insulation structural component 204, which may be anchored at room temperature on one end to the bottom plate 222 via coupling member 230, and at the other end, it may be coupled with coupling plate 214 via coupling member 224. A second cylindrical tube made of fiber glass epoxy composite may be used as conduction insulation structural component 208, which may be coupled to the coupling plate 214 on one end, and to the magnet support plate 220 at the other end. In this embodiment, the resulting arrangement places the composite cylinder 208 inside the volume created by the composite cylinder 204.

In various embodiments, the coupling plate 214 may be cooled by the first stage of the cryocooler 118, shown in FIG. 1, and may be a part of the radiation shield (cryocooler and the connections not shown in this figure.) The cold-mass 210 may be cooled by the second stage of the cryocooler. A result of this configuration is that conduction heat leak from the room temperature anchor at coupling member 230 to the coupling plate 214 is transferred to the first stage of the cryocooler through the non coupling plate 214, and this plate is substantially maintained at a low desired temperature, for example, at 30-60 K. Since the amount of heat conducted through the conduction insulation structural component or cylinder 208 to the cold-mass 210 is a function of the temperature differential between its warm end and cold end, lowering the warm end temperature of cylinder 208 to a low desired temperature such as 30-60 K, can result in reducing the total heat conducted to the cold-mass to a level within the cooling capacity of the second stage of the cryocooler.

Thus, heat gained by the cold-mass 210, by conduction heat transfer is reduced by several factors including increased length of path for heat conduction through various plates 220, 214, and 222, and the various conduction insulation structural components 204 and 208 coupled between these plates; the low-conductive material used for the structural components such as various polymers; and the low temperature differential between the respective two ends of the radiation insulation structural component 206, when applicable as further described below. The conductive heat transfer path from the cold mass (for example, a superconducting magnet) to the surrounding environment includes structural components which are coupled together thermally in series. That is, thermal energy flows in ordered sequence from the cold mass through the various plates 220, 214, and 222, and the various conduction insulation structural components 204 and 208 coupled between these plates in series, or a linear path, to the outside environment.

In various embodiments, a radiation shield 206, which may or may not be a radiation insulation structural component, in the form of a cylinder, may be radially enclosed between conduction insulation structural components 204 and 208, and axially between coupling plate 214 on top and radiation shield plate 232 or bottom plate 222 at the bottom, depending on the embodiment. A surface of the radiation shield facing outwards towards the surrounding environment and away from the cold-mass 210 may be coated and/or covered with one or more reflective or shiny layers, and/or low emissivity covers such as superinsulation, to reflect and reduce radiation mode heat transfer to the cold mass. As radiation heat from surrounding environment, shown as curly arrow 248 hits the outward surface of cylinder 206, the reflective and/or low emissivity surfaces cause most of the radiation to be reflected back to the external environment as reflected rays 246.

In various embodiments, the radiation shield 206 may be structural member enclosed between the coupling plate 214 and bottom plate 222, and perform a structural function within the magnet system. In these embodiments, the bottom plate 222 may include an additional radiation shielding layer or surface. In other embodiments, the radiation shield 206 may be coupled at the lower side only with radiation shield plate 232 without being coupled with bottom plate 222, thus, not performing a structural function. In some embodiments, polished aluminum, copper, stainless steel, or other similar metallic material may be used to make the radiation shield 206. However, aluminum is a good conductor of heat and electricity, and thus, in structural embodiments where the radiation shield cylinder is coupled with a structural bottom plate, excessive heat conduction may create excessive heat leak. As such, conduction between bottom plate 222 and coupling plate 214 may be increased, defeating the purpose of limiting heat transfer via conduction mode. To overcome heat conduction via radiation shield, the end plates (plates 214 and 222) enclosing the radiation shield 206 may be maintained at substantially the same or close temperature to reduce temperature differential across radiation shield 206. In the absence of an appreciable temperature differential, very little or no conduction heat transfer can take place through radiation shield 206. In embodiments where the radiation shield is not coupled with the bottom plate, conduction through the radiation shield is not a concern since there is no path for conduction of heat to surrounding environment.

FIG. 3 shows an alternative example cross section of another example embodiment vacuum chamber containing structural support for a superconducting magnet thermally insulated from its external environment. In various embodiments, magnet system 300 includes an outer housing of a vacuum vessel 302, a radiation shield or radiation insulation structural component 312 to reflect incident thermal radiation 324 as reflected thermal radiation 326, the radiation shield 312 being coupled with top plate 330 via coupling member 316 at one end, and coupled with a bottom plate 308 at the other end. A conduction insulation structural component 314 is coupled with top plate 330 at one end, and coupled with a cold mass or superconducting magnet 310 at the other end via magnet support plate 328. Another structural component 306 supports the structure above it, as shown, on system feet 304.

In various embodiments, a cylindrical tube made of fiber glass epoxy composite such as Garolite may be used to implement the structural component 306, which may be anchored at room temperature on one end to system feet 304, and the other end may be coupled to bottom plate 308. A second cylindrical tube 314 made of fiber glass epoxy composite may be used to implement the conduction insulation structural component 314, which may be coupled to top plate 330 on one end, and coupled to the magnet support plate 328 at the other end to support the superconducting magnet 310. In this embodiment, the magnet support plate 328 is suspended from cylinder 314 to support the weight of the magnet from magnet's top side. In a variation of the embodiment shown, the cylinder 314 may extend down to the bottom of the magnet 310 and coupled with the magnet support plate 328 on which the magnet 310 rests, thus, supporting the magnet from the magnet's bottom side. That is, the superconducting magnet 310 may either rest on magnet support plate 328, or be suspended from the plate, as shown in FIG. 2. A third cylindrical tube may be used to implement the radiation shield 312, and be coupled to the bottom plate 308 at one end, and to top plate 330 at the other end. As a result of this arrangement, cylinder 314 does not occupy the free space created inside composite cylinder 306. Arrows 318, 320, and 322 indicate the path conductive heat takes from the cold-mass to the external environment, through components 314, 330, and 312, respectively.

In various embodiments, cylinder 312, plate 308, and plate 330 may be parts of the radiation shield. Plates 308 and/or 330 may be cooled by the first stage of a cryocooler (cryocooler and the connections not shown) The superconducting magnet is cooled by the second stage of a cryocooler. The result of this configuration is that heat transfer from the room temperature at system feet 304 to the plate 308 and coupling component 330 is captured by the first stage of the cryocooler, maintaining the plates at a desired low temperature, such as of 30-60 K. Since the amount of heat conducted through cylinder 314 to the superconducting magnet depends on the temperature differential between the cylinder's warm end and cold end, lowering the warm end temperature of cylinder 314 to the desired low temperature, such as 30-60 K can result in reducing or eliminating the total heat conducted to the superconducting magnet to a level within the cooling capacity of the second stage of a cryocooler.

Those skilled in the art will appreciate that, the various embodiments described herein including the components of systems shown in FIGS. 2 and 3 are for purposes of illustrating how heat transfer by conduction from room temperature to the cold mass is reduce by the disclosed components and configurations, and that FIGS. 2 and 3 are not complete representations of the structure of superconducting magnets.

Those skilled in the art will further appreciate that the embodiments described herein may have fewer or more components than shown and described. For example, coupling components 224 and 316, shown in FIGS. 2 and 3, respectively, may or may not be used in various embodiments. Similarly, additional concentric or nested cylinders for reducing conduction and radiation modes of heat transfer may be employed.

Those skilled in the art will appreciate that, in various embodiments disclosed herein, the structural support components may be have any cross-sectional or geometric shape, such as circle, rectangle, square, triangle, polygonal, irregular, and the like. Accordingly, when discussing cylinders, all other shapes are included and may be used for the structural components. Additionally, the cylinder may be a solid tube of circular or non-circular cross section and of uniform thickness or otherwise, and of constant perimeter or otherwise. In other embodiments, the structural components may include an array of discrete members or rods of solid or tubular cross section, that are arranged in a such way to form a container or volume with partially closed walls or surfaces like a 'bird cage' with an overall circular or non-circular cross section. Each discrete body may have a circular cross section such as a bar or a tube, or rectangular such as a plate, a strip, or other cross section. The walls of the structural components, such as conduction insulation structural components, may further be solid without pass-through holes, or not be solid and include perforations, holes, cut-outs of different shapes, and the like.

In various embodiments disclosed and described herein, a superconducting magnet may include one or more of a coil or winding, solenoidal or otherwise in shape; a bobbin or former surrounding the coil; an iron yoke of a particular shape; and other auxiliary devices.

In various embodiments, a plate may be a solid plate of circular shape or otherwise with or without holes and other features, an annulus of circular shape or other shapes with or without holes and other features.

Changes can be made to the claimed invention in light of the above Detailed Description. While the above description details certain embodiments of the invention and describes the best mode contemplated, no matter how detailed the above appears in text, the claimed invention can be practiced in many ways. Details of the system may vary considerably in its implementation details, while still being encompassed by the claimed invention disclosed herein.

Particular terminology used when describing certain features or aspects of the invention should not be taken to imply that the terminology is being redefined herein to be restricted to any specific characteristics, features, or aspects of the invention with which that terminology is associated. In general, the terms used in the following claims should not be construed to limit the claimed invention to the specific embodiments disclosed in the specification, unless the above Detailed Description section explicitly defines such terms. Accordingly, the actual scope of the claimed invention encompasses not only the disclosed embodiments, but also all equivalent ways of practicing or implementing the claimed invention.

The above specification, examples, and data provide a complete description of the manufacture and use of the composition of the invention. Since many embodiments of the invention can be made without departing from the spirit and scope of the invention, the invention resides in the claims hereinafter appended. It is further understood that this disclosure is not limited to the disclosed embodiments, but is intended to cover various arrangements included within the spirit and scope of the broadest interpretation so as to encompass all such modifications and equivalent arrangements.

It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations). Furthermore, in those instances where a convention analogous to "at least one of A, B, and C, etc." is used, in general such a construction is intended in the sense one having skill in the art would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one having skill in the art would understand the convention (e.g., "a system having at least one of A, B, or C" would include but not be limited to systems that have A alone, B alone, C alone, A and B together, A and C together, B and C together, and/or A, B, and C together, etc.). It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

While the present disclosure has been described in connection with what is considered the most practical and preferred embodiment, it is understood that this disclosure is not limited to the disclosed embodiments, but is intended to cover various arrangements included within the spirit and scope of the broadest interpretation so as to encompass all such modifications and equivalent arrangements.

What is claimed is:

1. A structural support system for supporting a cold mass, the structural support system comprising:

a vacuum vessel configured to be evacuated from heat conducting fluids to eliminate convection heat transfer to the cold mass;

a cold mass physically attached to and supported by a base of a first conduction insulation structural component, wherein the first conduction insulation structural component is a first container enclosed within the vacuum vessel and having the base, a sidewall enclosing an internal space of the first container and physically attached to the base; and a second conduction insulation structural component, being a second container enclosed within the vacuum vessel, enclosing the first container, and having a base, a sidewall enclosing an internal space of the second container and physically attached to the base of the second container, the sidewall of the second container also enclosing the sidewall of the first container, wherein both the sidewall of the first container and the sidewall of the second container are physically attached to a coupling plate, distinct from a top plate of the vacuum vessel, the top plate being physically attached to a sidewall of the vacuum vessel, and wherein an end-to-end linear path for conductive heat transfer having one end at the cold mass and another end at an environment surrounding the vacuum vessel, is formed from the cold mass through the base of the first container, the sidewall of the first container, the coupling plate, the sidewall of the second container, and the base of the second container, and wherein no other thermal conduction path exists between the cold mass and the environment surrounding the vacuum vessel.

2. The structural support system of claim 1, further comprising a radiation shield axially enclosed between the coupling plate and a bottom plate of the vacuum vessel.

3. The structural support system of claim 2, wherein the radiation shield is made of aluminum, copper, or stainless steel and is enclosed within the second conduction insulation structural component.

4. The structural support system of claim 2, wherein the coupling plate and the bottom plate are maintained at a same temperature to reduce thermal conduction through the radiation shield.

5. The structural support system of claim 2, wherein the first and the second conduction insulation structural components and the radiation shield are nested cylinders, with the first conduction insulation structural component being enclosed by the radiation shield, and the radiation shield being enclosed by the second conduction insulation structural component.

6. The structural support system of claim 5, wherein the first and the second conduction insulation structural components have a second moment of inertia to prevent deforming the structural support system due at least to the weight of support structure and cold mass during rotational and translational motion.

7. The structural support system of claim 1, wherein the second and the first conduction insulation structural components are made of low-heat conductivity materials including one of a polymer and a fiber reinforced polymer.

8. The structural support system of claim 1, further comprising a two-stage cryocooler and wherein the cold mass is a superconducting magnet.

9. A structural support system for supporting a cold mass, the structural support system comprising:

a vacuum vessel configured to be evacuated from heat conducting fluids to eliminate convection heat transfer to the cold mass;

a cold-mass physically attached to and supported by a first conduction insulation structural component, wherein the first conduction insulation structural component is a first container enclosed within the vacuum vessel and having the base, a sidewall enclosing an internal space of the first container and physically attached to the base;

a radiation shield component physically coupled with the first conduction insulation structural component, and anchored to and within the vacuum vessel, wherein the first conduction insulation structural component is enclosed within the radiation shield component, and wherein the radiation shield component has a base, a sidewall enclosing an internal space of the radiation shield component and physically attached to the base of the radiation shield component, the sidewall of the radiation shield component also enclosing the sidewall of the first container, wherein both the sidewall of the first container and the sidewall of the radiation shield component are physically attached to a coupling plate, distinct from a top plate of the vacuum vessel, the top plate being physically attached to a sidewall of the vacuum vessel; and a second container enclosed within the vacuum vessel, enclosing the first container and the radiation shield component, and having a base and a sidewall physically attached to the coupling plate and enclosing an internal space of the second container and physically attached to the base of the second container, the sidewall of the second container also enclosing the sidewall of the first container and the sidewall of the radiation shield component, wherein an end-to-end linear path for conductive heat transfer having one end at the cold mass and another end at an environment surrounding the vacuum vessel, is formed by conduction from the cold mass through the base of the first container, the sidewall of the first container, the coupling plate, the sidewall of the second container, and the base of the second container, and wherein thermal radiation between the cold mass and the environment surrounding the vacuum vessel is reduced by the radiation shield component to minimal amounts.

10. The structural support system of claim 9, further comprising a second conduction insulation structural component coupled with the radiation shield component.

11. The structural support system of claim 9, further comprising a two-stage cryocooler, wherein a first cooling stage of the two-stage cryocooler is configured to cool down the radiation shield component to a desired low temperature.

12. The structural support system of claim 9, wherein the radiation shield component and the first conduction insulation structural component are configured as nested cylinders having a second moment of inertia to prevent deformation of the structural support system due at least to the weight of support structure and cold mass during movement.

13. The structural support system of claim 9, wherein the radiation shield component is axially enclosed between a coupling plate and a bottom plate maintained at a same temperature to reduce conduction of heat to the cold-mass through the radiation shield component.

14. The structural support system of claim 9, wherein the radiation shield component is made of aluminum, copper, or stainless steel.

15. A method of structurally supporting a cold mass, the method comprising:

evacuating heat conducting fluids from a vacuum vessel to eliminate convection heat transfer to the cold mass;

insulating a cold-mass from conductive heat transfer using a first conduction insulation structural component, wherein the first conduction insulation structural component is a first container enclosed within the vacuum vessel and having a base, a sidewall enclosing an internal space of the first container and physically attached to the base; and further insulating the cold mass from conductive heat transfer using a second conduction insulation structural component, being a second container enclosed within the vacuum vessel, enclosing the first container, and having a base, a sidewall enclosing an internal space of the second container and physically attached to the base of the second container, the sidewall of the second container also enclosing the sidewall of the first container, the second conduction insulation structural component coupled thermally in series with the first conduction insulation structural component, wherein both the sidewall of the first container and the sidewall of the second container are physically attached to a coupling plate, distinct from and not touching a top plate of the vacuum vessel, the top plate being physically attached to a sidewall of the vacuum vessel, and wherein an end to end linear path for heat transfer having one end at the cold mass and another end at an environment surrounding the vacuum vessel, is formed from the cold mass through the base of the first container, the sidewall of the first container, the top plate, the sidewall of the second container, and the base of the second container, and wherein no other thermal conduction path exists between the cold mass and the environment surrounding the vacuum vessel.

16. The method of claim 15, further comprising insulating the cold mass from radiation heat transfer using a radiation shield.

17. The method of claim 16, wherein the radiation shield is axially enclosed between the coupling plate and a bottom plate maintained at a same temperature to reduce conduction of heat to the cold-mass through the radiation shield.

18. The method of claim 15, wherein the conduction insulation structural components are configured to have a second moment of inertia to prevent deformation of a structural support due at least to the weight of support structure and cold mass during rotational and translational motion.

19. The structural support system of claim 1, where in the coupling plate is an annulus.

* * * * *